US009781962B2

(12) United States Patent
McClure

(10) Patent No.: US 9,781,962 B2
(45) Date of Patent: Oct. 10, 2017

(54) PROTECTIVE CLOTHING SYSTEM

(71) Applicant: Midwest Armor, LLC, Bismarck, ND (US)

(72) Inventor: Tommy R. McClure, Bismarck, ND (US)

(73) Assignee: Midwest Armor, LLC, Bismarck, ND (US)

( * ) Notice: Subject to any disclaimer, the term of this patent is extended or adjusted under 35 U.S.C. 154(b) by 227 days.

(21) Appl. No.: 14/853,609

(22) Filed: Sep. 14, 2015

(65) Prior Publication Data

US 2017/0071276 A1 Mar. 16, 2017

(51) Int. Cl.

| | |
|---|---|
| ***A41D 13/00*** | (2006.01) |
| ***A41D 31/00*** | (2006.01) |
| ***A41D 13/04*** | (2006.01) |
| ***F41H 1/02*** | (2006.01) |

(52) U.S. Cl.
CPC ..... *A41D 31/0061* (2013.01); *A41D 13/043* (2013.01); *F41H 1/02* (2013.01); *A41D 13/0005* (2013.01); *A41D 13/0007* (2013.01)

(58) Field of Classification Search
CPC ..... A41D 31/0061; A41D 13/043; A41D 13/0007; A41D 13/0005
See application file for complete search history.

(56) References Cited

U.S. PATENT DOCUMENTS 3,561,394 A * 2/1971 Pickens ..... A41D 13/01 116/200
3,577,836 A * 5/1971 Tamura ..... A41D 31/0061 2/2.5
4,425,667 A * 1/1984 Harrison ..... A41D 13/0153 2/16
4,602,385 A * 7/1986 Warren ..... A41D 13/0153 2/2.14
5,073,988 A * 12/1991 Lewis, Jr. ..... A41D 19/0041 2/123
5,088,116 A 2/1992 Gould
7,865,967 B2 * 1/2011 Van Winkle ..... F41H 1/02 2/102

(Continued)

OTHER PUBLICATIONS http://www.dsm.com/products/dyneema/en_US/product-technologies/ud/sb21.html; Dyneema SB21 Webpage; Received and Printed Sep. 13, 2015.

(Continued)

*Primary Examiner* — Shaun R Hurley
*Assistant Examiner* — Andrew W Sutton
(74) *Attorney, Agent, or Firm* — Neustel Law Offices

(57) ABSTRACT

A protective clothing system for protecting a user from high velocity particles and lacerating objects. The protective clothing system generally includes a clothing item having a front portion and a rear portion. The front portion of the clothing item is constructed of three to fifteen sheets of protective material to protect the front portion of the body of the user from high velocity particles and lacerating objects. The rear portion of the clothing item may have no protective material or significantly less sheets of protective material compared to the front portion to help reduce the weight of the clothing item. The joints of the clothing item corresponding to the human joints are relatively free moving to provide increased mobility to the user.

7 Claims, 14 Drawing Sheets

(56) References Cited

U.S. PATENT DOCUMENTS

| | | | | |
|---|---|---|---|---|
| 2005/0059307 | A1* | 3/2005 | Moeseke | A41D 31/0061 442/134 |
| 2008/0092599 | A1* | 4/2008 | Hazan | A41D 31/0061 66/202 |
| 2008/0098500 | A1 | 5/2008 | Matic | |
| 2008/0155737 | A1* | 7/2008 | Marchesi | F41H 1/02 2/456 |
| 2008/0289087 | A1* | 11/2008 | Sundnes | A41D 31/0061 2/456 |
| 2012/0079639 | A1* | 4/2012 | Hughes | A41D 13/043 2/2.5 |
| 2012/0174753 | A1* | 7/2012 | Wagner | F41H 1/02 89/36.02 |
| 2012/0240317 | A1* | 9/2012 | Diamond | A41D 13/0153 2/459 |

OTHER PUBLICATIONS http://www.dsm.com/content/dam/dsm/dyneema/en_GB/Downloads/LP%20Product%20Grades/DSM_PSS_SB21.pdf; Dyneema SB21 Product Specification Sheet; Received and Printed Sep. 13, 2015.

http://www.dsm.com/products/dyneema/en_US/product-technologies/fiber.html; Dyneema Fiber Webpage; Received and Printed Sep. 13, 2015.

http://www.dsm.com/products/dyneema/en_US/industries/cut-resistant-gloves.html; Dyneema Cut Resistant Gloves Webpage; Received and Printed Sep. 13, 2015.

http://www.dsm.com/products/dyneema/en_US/industries/military-law-enforcement/personal-armor.html; Dyneema Personal Armor Webpage; Received and Printed Sep. 13, 2015.

http://www.dsm.com/products/dyneema/en_US/industries/military-law-enforcement/personal-armor/armor-vests.html; Dyneema Ballistic Vests Webpage; Received and Printed Sep. 13, 2015.

www.dsm.com/products/dyneema/en_US/industries/military-law-enforcement/personal-armor/armor-plates-and-inserts.html; Dyneema Body armor.. Webpage; Received and Printed Sep. 13, 2015.

http://www.dsm.com/products/dyneema/en_US/industries/military-law-enforcement/personal-armor/civilian-armor.html; Dyneema Civilian Armor Webpage; Received and Printed Sep. 13, 2015.

* cited by examiner

PROTECTIVE CLOTHING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to protective clothing and more specifically it relates to a protective clothing system for protecting a user from high velocity particles and lacerating objects.

Description of the Related Art

Any discussion of the related art throughout the specification should in no way be considered as an admission that such related art is widely known or forms part of common general knowledge in the field.

Workers in various types of industries (e.g. oil drilling industry, coal mining industry, rock crushing, etc.) are subject to work environments where their bodies may be penetrated by particles (e.g. small, high-velocity particles) or subject to severe lacerations by objects (e.g. cable strand lash. For example, jobs that involve hammering operations or working in explosive environments may generate flying particles such as metal particles and rock particles that can cause bodily injury to the worker. In addition, jobs that require the worker to work near objects under tension (e.g. cables under tension) may be subject to a sudden failure resulting in a laceration.

Conventional work clothing is not suitable for protecting a worker from flying particles or lacerating objects. Protective clothing such as body armor that is suitable for protecting workers is simply too heavy, bulky and difficult to move within to be worn for extended periods of time.

Because of the inherent problems with the related art, there is a need for a new and improved protective clothing system for protecting a user from high velocity particles and lacerating objects.

BRIEF SUMMARY OF THE INVENTION

Provided herein is a protective clothing system which includes a clothing item having a front portion and a rear portion. The front portion of the clothing item is constructed of three to fifteen sheets of protective material to protect the front portion of the body of the user from high velocity particles and lacerating objects. The rear portion of the clothing item may have no protective material or significantly less sheets of protective material compared to the front portion to help reduce the weight of the clothing item. The joints of the clothing item corresponding to the human joints are relatively free moving to provide increased mobility to the user.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
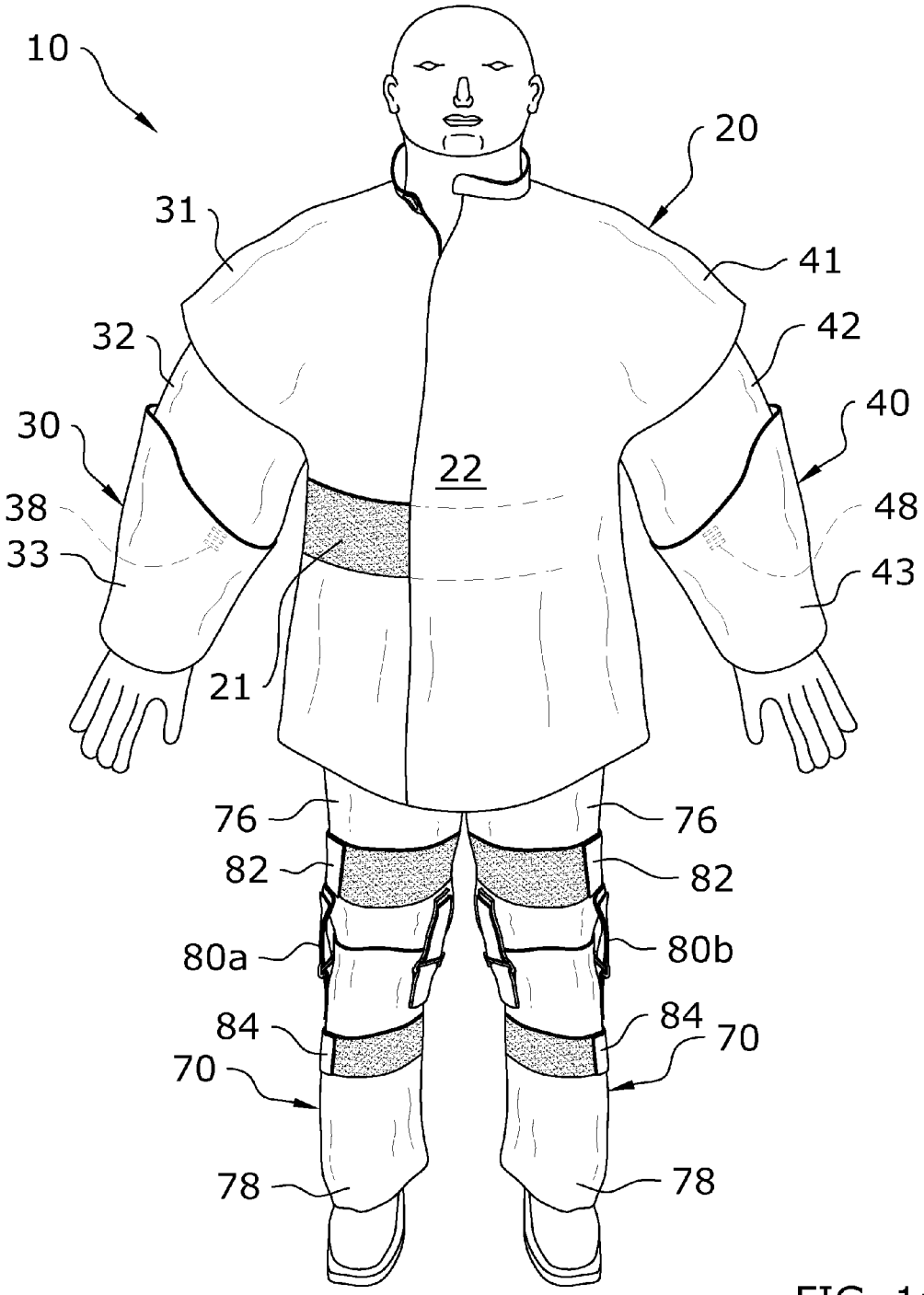
FIG. 1*a* is front view of the present invention.

Turning now descriptively to the drawings, in which similar reference characters denote similar elements throughout the several views, FIGS. 1*a* through 9 illustrate a protective clothing system 10, which comprises a clothing item 20, 70 having a front portion and a rear portion. The front portion of the clothing item 20, 70 is constructed of three to fifteen sheets of protective material to protect the front portion of the body of the user from high velocity particles and lacerating objects. The rear portion of the clothing item 20, 70 may have no protective material or significantly less sheets of protective material compared to the front portion to help reduce the weight of the clothing item 20, 70. The joints of the clothing item 20, 70 corresponding to the human joints are relatively free moving to provide increased mobility to the user.

B. Protective Material

Each layer (sheet) of protective material used is comprised of a low weight material to reduce the overall weight of the clothing item 20, 70 which is important when the clothing item 20, 70 is being worn for extended periods of time throughout the day (e.g. 8 hours). The protective material is preferably comprised of a fiber based composite laminate that is flexible. The protective material is further preferably comprised of a ballistic resistant type of fabric material. The protective material is preferably comprised of a plastic textile fiber such as polyethylene fiber. The protective material is further preferably comprised of a woven or non-woven polyethylene fabric for use in the manufacture of protective clothing. The protective material is further preferably comprised of an ultra-high molecular weight polyethylene fiber based composite laminate used in low weight soft armor applications.

A suitable protective sheet material is manufactured by DSM Dyneema B.V. (The Netherlands) under the brand name DYNEEMA®. The applicant has found that DYNEEMA® SB21 manufactured by DSM Dyneema to be a suitable low weight sheet of protective material with protective properties useful in constructing the clothing item 20, 70. DYNEEMA® SB21 is an ultra-high molecular weight polyethylene fiber based composite laminate for low weight soft armor applications manufactured by DSM Dyneema. A roll of DYNEEMA® SB21 consists of four single layers of unidirectional sheet cross plied at ninety degrees to each other, consolidated with a rubber based matrix and covered with a protective film to form a single sheet of protective material.

When using the DYNEEMA® SB21 protective material to protect important areas of the clothing item 20, 70 (e.g. the front portion or portions of the front portion), the applicant has found that it is preferable to use between 3 to 15 sheets of the protective material layered together to provide a preferred level of protection from fast moving objects while minimizing the weight of the clothing item 20, 70. The applicant has also preferably found it preferable to use approximately 6 layers (sheets) of protective material 12 of the DYNEEMA® SB21 protective material in at least the front portion of the clothing item 20, 70 as illustrated in FIG. 8 of the drawings.

Figure 8:
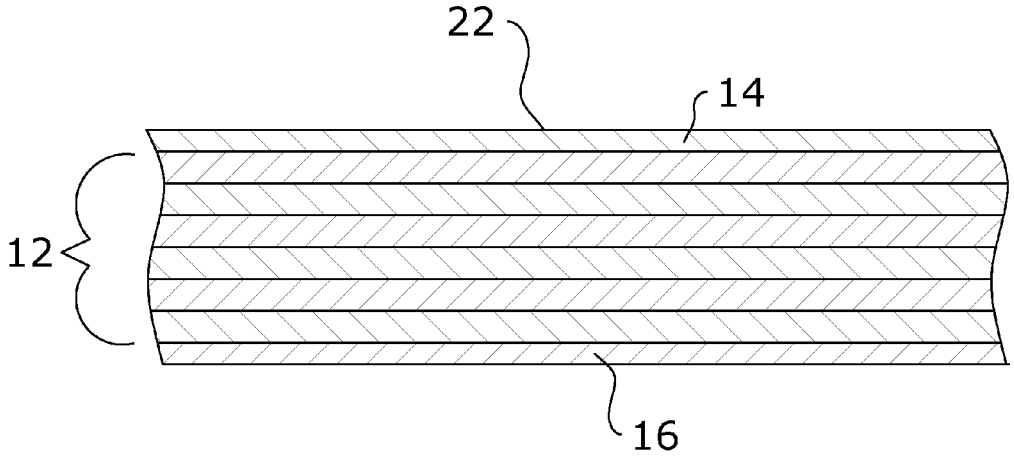
FIG. 8 is a cross sectional view illustrating an embodiment using six sheets of protective material for the front portion of the present invention.
Figure 9:
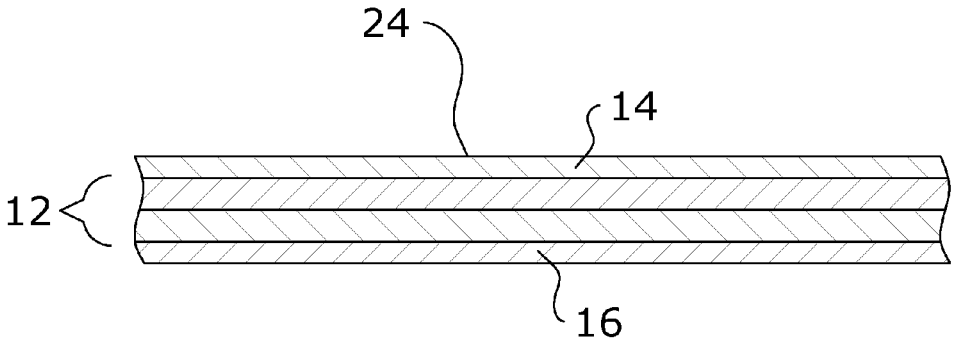
FIG. 9 is a cross sectional view illustrating an embodiment using two sheets of protective material for the rear portion of the present invention.

The plurality of sheets of protective material are covered by an outer layer 14 positioned on an exterior of the protective clothing item 20, 70 and an inside layer 16 positioned on an interior of the protective clothing item 20, 70 as illustrated in FIGS. 8 and 9 of the drawings. The outer layer 14 and the inside layer 16 are preferably not comprised of protective material but may be comprised of a protective material. The outer layer 14 is further preferably comprised of a light reflective material to increase visibility of the user in low light conditions.

C. Clothing Item—Generally

Figure 1B:
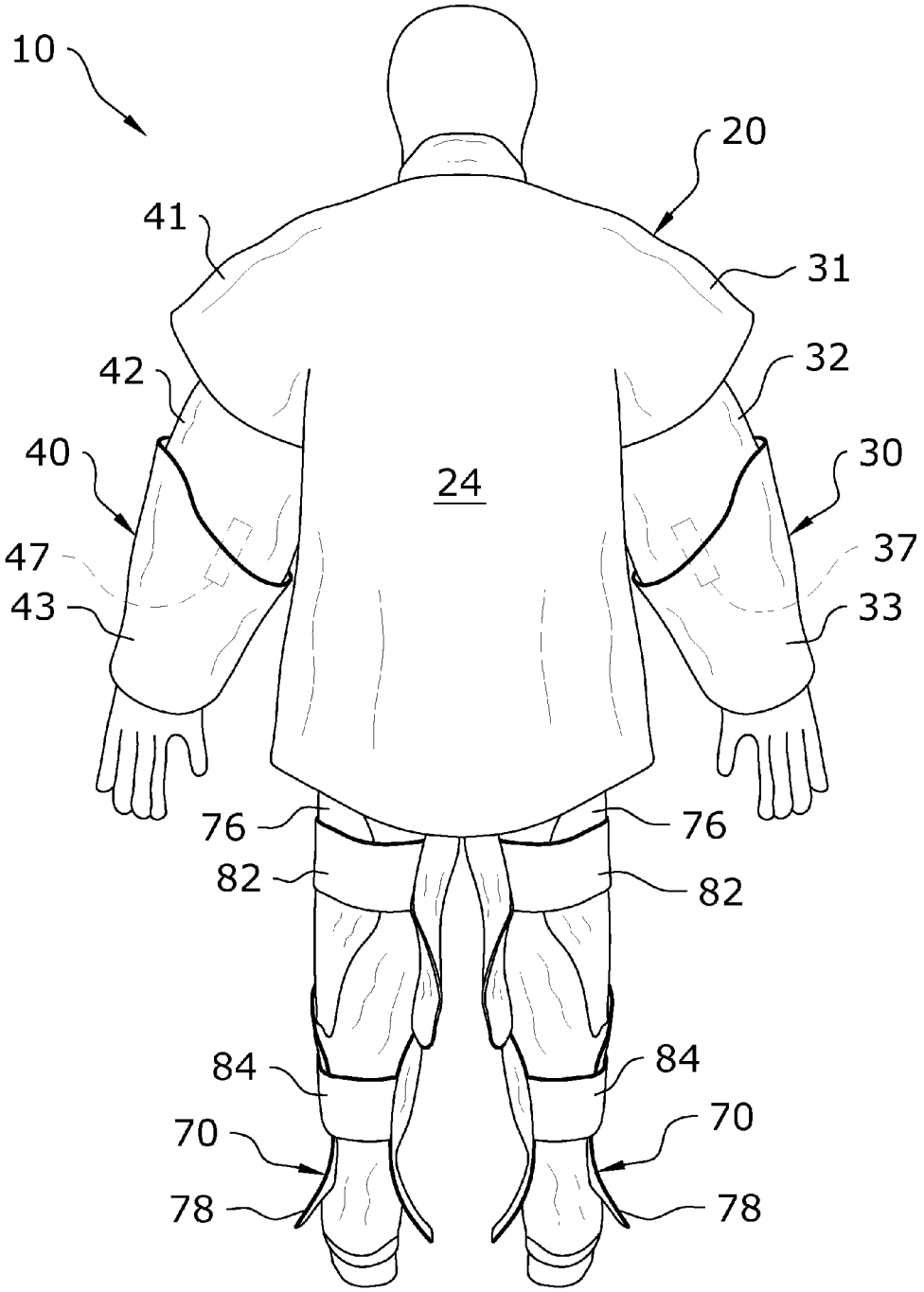
FIG. 1*b* is a rear view of the present invention.
Figure 2A:
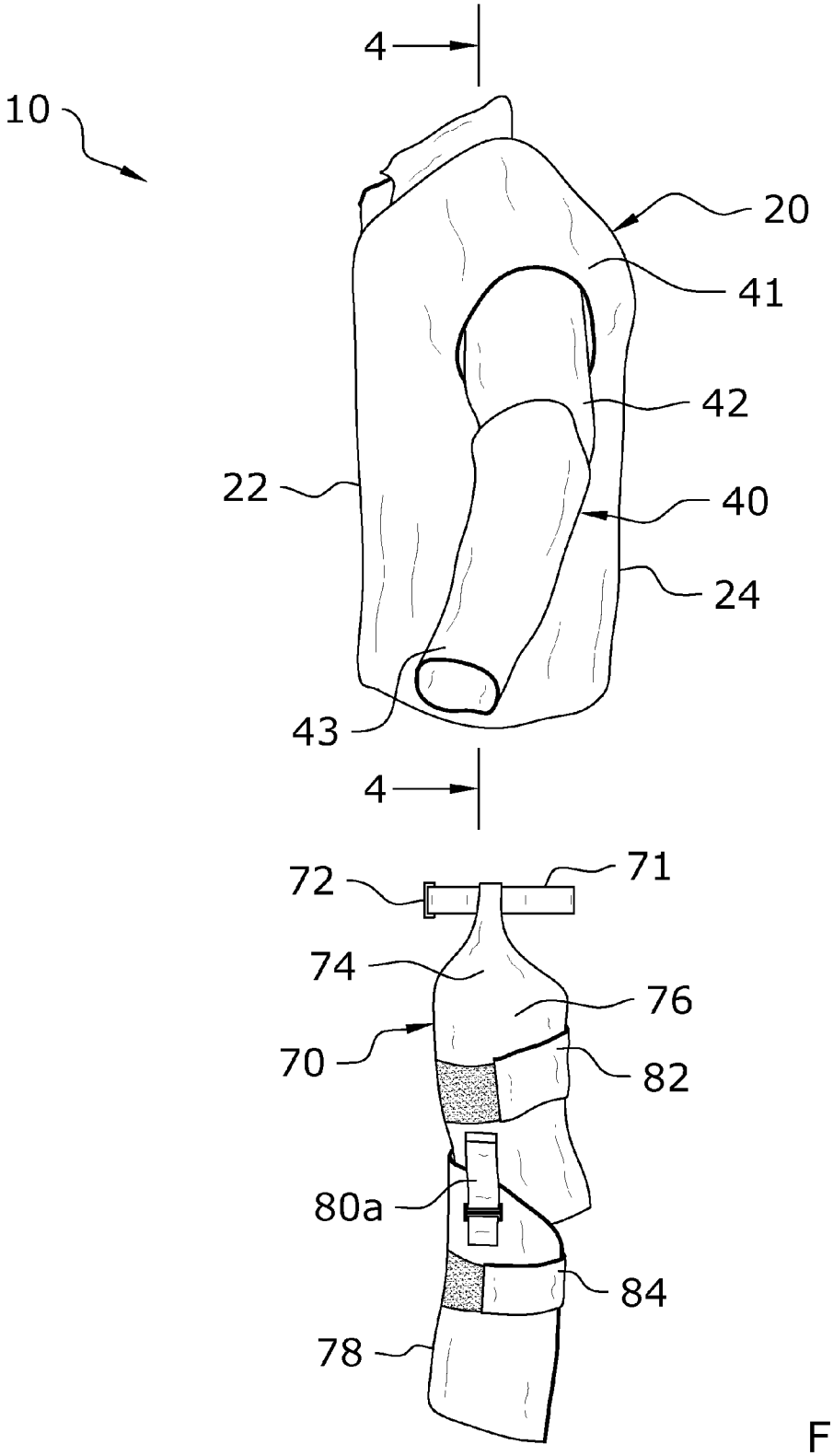
FIG. 2*a* is a left side view of the present invention.
Figure 2B:
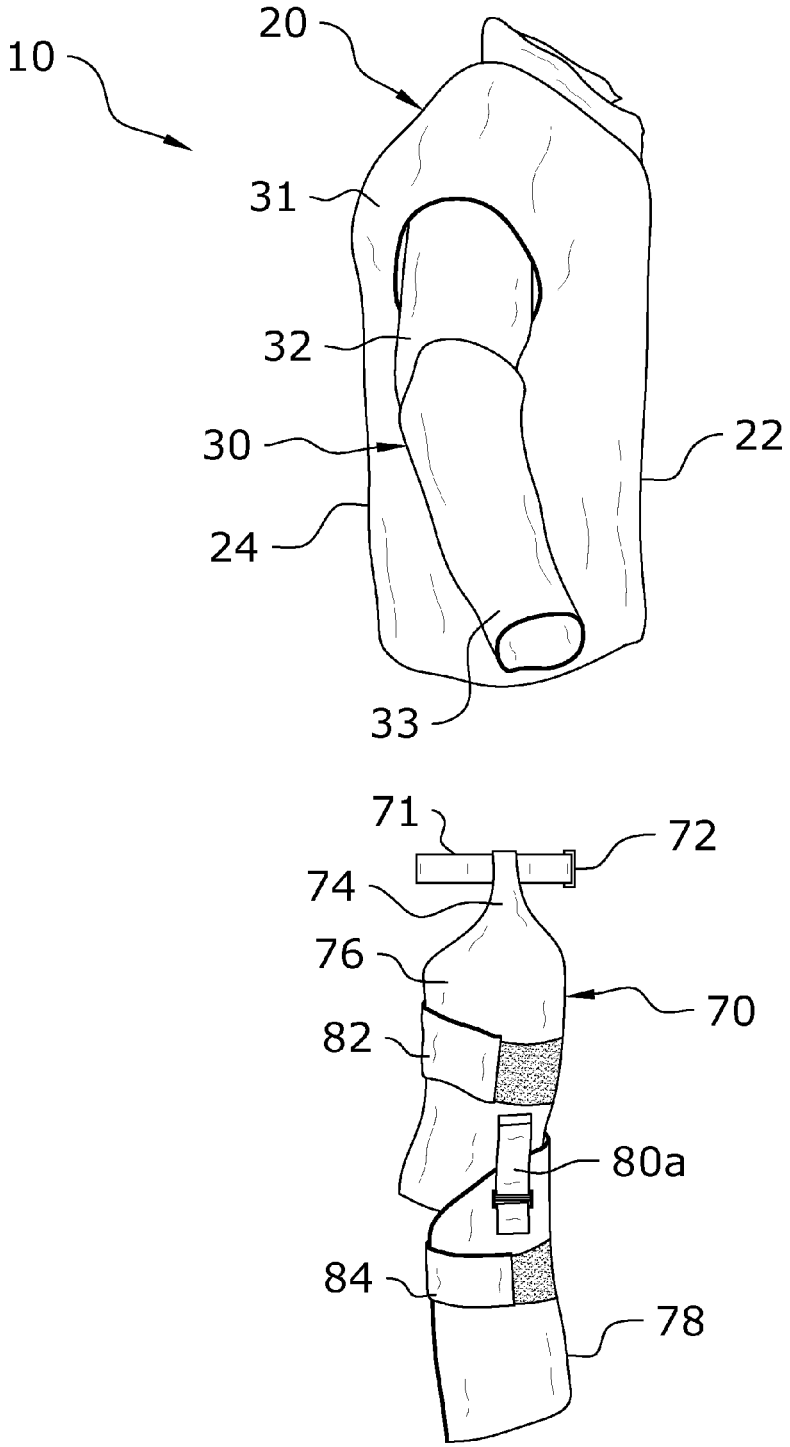
FIG. 2*b* is a right side view of the present invention.

The present invention may be comprised of various types of clothing items 20, 70 suitable for wearing by a user such as a worker in an industry where fast moving particles and/or lacerations are possible. The present invention may be comprised of clothing items 20, 70 that are large enough to cover conventional clothing worn by the user or clothing items 20, 70 that are to be worn without conventional clothing beneath. The clothing item 20, 70 may or may not be insulated. The clothing item 20, 70 may also be fire resistant and/or water resistant. In addition, reflective material may be attached to the exterior of the clothing item 20, 70 to increase visibility of workers in darkened conditions. For example, the present invention may be comprised of coveralls to cover the legs, torso and arms of the user. The present invention may also be comprised of a coat 20, jacket or shirt to protect the upper body of a user. The present invention may also be comprised of bib overalls, pants or chaps 70 to protect the lower body of a user. The present invention may be comprised of any combination of clothing items 20, 70 such as, but not limited to, a coat 20 and a pair of chaps 70 as illustrated in FIGS. 1 through 2*b* of the drawings.

The clothing item 20, 70 has a front portion and a rear portion. The front portion and the rear portion may be comprised of a single sheet of material or a plurality of sheets of material attached together. The rear portion may be comprised of protective material, non-protective material or with little to no material (i.e. at least partially open exposing the user without covering the rear of the user). The front portion of the clothing item 20, 70 is constructed of a plurality of sheets (a.k.a. layers, plies) of protective material layered to form the front portion to protect the user from high velocity particles such as metal and rocks. The front portion also protects the user from lacerations from objects under tension such as a cable fraying.

The front portion of the clothing item 20, 70 is capable of preventing penetration of a high-velocity particle and lacerations by cable strand lash. It is preferable that the front portion of the clothing item 20, 70 is capable of preventing penetration of a high-velocity particle up to 40 grain at 1,000 fps. It is preferable that at least a significant portion of the front portion of the clothing item 20, 70 has significantly more sheets of protective material at a preferred minimum level of protection compared to the rear portion. The preferred level of protection for the front is designed to protect at a minimum against 40 grain deformable projectiles travelling at 1,000 feet per second or less.

While it is preferable that the entire front portion of the clothing item 20, 70 be constructed to the preferred minimum level of protection, but some areas of the front portion may have increased protection (i.e. increased number of sheets of protective material) and other areas of the front portion may have reduced protection (i.e. decreased number of sheets of protective material) to help reduce the weight of the clothing item 20, 70. It is important to maintain a minimum level of flexibility throughout the entire clothing item 20, 70 similar to conventional clothing to maintain mobility and to ensure the user is able to have a full range of body movements compared to the limited movements encountered when wearing body armor.

The clothing item 20, 70 preferably includes at least two portions movably connected together at a joint that corresponds to a body joint of a user. More than one joint may exist in the clothing item 20, 70 as needed to conform to the user's body joints (e.g. knee, hip, elbow, shoulder, wrist joints). The joint in the clothing item 20, 70 connects the two portions in a loose manner preferably with one or more straps. The straps may or may not be comprised of elastic material, wherein elastic straps are preferred to allow for increased flexibility of the joint. In addition, the two portions of the clothing item 20, 70 may be connected in one or more locations in a relatively non-movable manner with a fastener such as threading or other type of fastener.

D. Clothing Item—Coat Embodiment

FIGS. 1*a* through 6 illustrate the clothing item 20, 70 being comprised of a coat 20 having a torso portion along with a right sleeve 30 and a left sleeve 40 extending from upper portions of the torso portion. FIGS. 1*a* through 2*b* illustrate the combination of the coat 20 along with a pair of chaps 70. It can be appreciated that the invention may be comprised of just a coat 20, a pair of chaps 70 or a combination of both (or a combination of various other types of clothing items 20, 70 as discussed above).

Figure 3A:
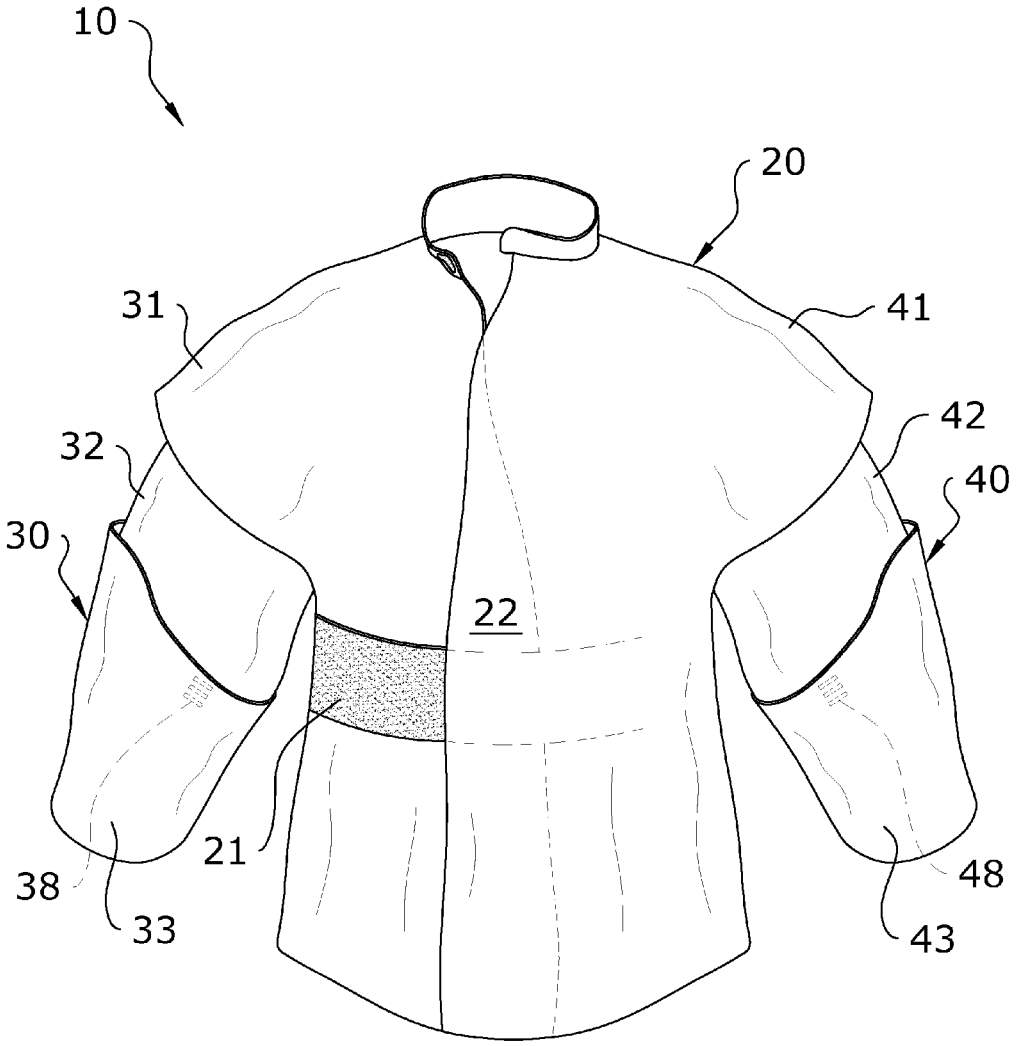
FIG. 3*a* is a front view of the coat embodiment of the present invention.
Figure 3B:
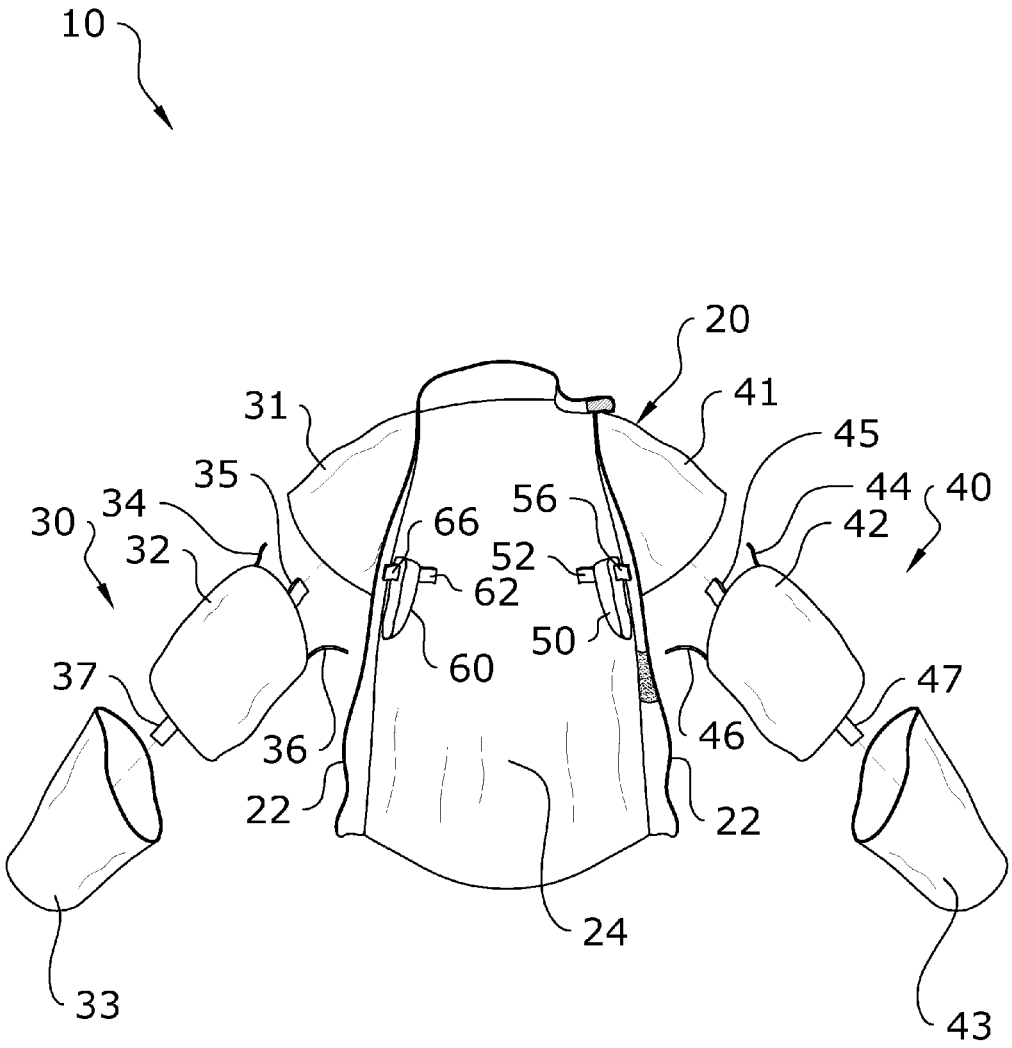
FIG. 3*b* is an exploded front view of the coat embodiment.

The torso portion of the coat 20 is comprised of a front torso portion 22 and a rear torso portion 24 as illustrated in FIGS. 3*a* and 3*b* of the drawings. The front torso portion 22 covers and protects the front portion of the user as illustrated in FIG. 1*a*. The rear torso portion 24 covers (and protects if constructed of protective material) the rear portion of the user as illustrated in FIG. 1*b* of the drawings. The front torso portion 22 of the coat 20 may be a solid sheet of material or may be split in the middle as illustrated in FIGS. 3*a* and 3*b*. If the front torso portion 22 is split, it is preferable that the two opposing portions of the front torso portion 22 overlap with hook and loop fastener 21 securing the two opposing portions together as illustrated in FIG. 3*a*. The torso portion of the coat 20 preferably extends down to the upper thigh area of the user and overlaps the pair of chaps 70 as illustrated in FIG. 1*a*.

The rear torso portion 24 is preferably a single sheet of material which may or may not be comprised of protective material. The rear torso portion 24 may be comprised of protective material but the number of layers of protective material 12 is significantly lower than the layers of protective material 12 used for the front portion of the clothing item 20, 70 to reduce the overall weight of the clothing item 20, 70 while providing some protection from lower velocity particles. FIG. 8 illustrates an example of 6 layers of protective material 12 surrounded by the outer layer 14 and the inside layer 16 for the front portion of the clothing item 20, 70. FIG. 9 illustrates an example of 2 layers of protective material 12 surrounded by the outer layer 14 and the inside layer 16 for the rear portion of the clothing item 20, 70. As discussed, the rear portion may have no protective material and instead just conventional clothing material used to construct the rear portion of the clothing item 20, 70.

The right sleeve 30 includes a right inner joint connected to the torso portion of the coat 20 and a middle joint as illustrated in FIGS. 3*a* through 3*b*. The right sleeve 30 is preferably not directly attached to the torso portion and instead is indirectly attached to the torso portion. The right inner joint is preferably comprised of a plurality of straps attached between the torso portion of the coat 20 and the right sleeve 30. The straps are preferably comprised of elastic straps to allow for increased mobility of the arm of the user during movement of the arm (e.g. raising the arm, moving the arm forward or rearward).

The right sleeve 30 is preferably comprised of a right inner portion 31 that extends outwardly from the upper portion of the torso portion of the coat 20 as illustrated in FIGS. 3*a* through 3*b* of the drawings. The right inner portion 31 is preferably integrally formed with the torso portion but may be attached to the torso portion. The right inner portion 31 extends outwardly from the right side of the torso portion a distance approximately equal to ⅓ of the length of the right sleeve 30 to protect the upper portion of the arm of the user. The right inner portion 31 forms a right distal opening that receives a right middle portion 32 of the right sleeve 30. The right middle portion 32 preferably has an inner end that has a smaller diameter than the right distal opening formed by the right inner portion 31 to movably receive the right middle portion 32 within the right inner portion 31 of the right sleeve 30 thereby allowing relatively free movement of the right middle portion 32 with respect to the right inner portion 31. There is further a sufficient overlapping of the right inner portion 31 over the right middle portion 32 such than the range of movements of the right arm of the user does not expose any portion of the right arm during movement.

Figure 4:
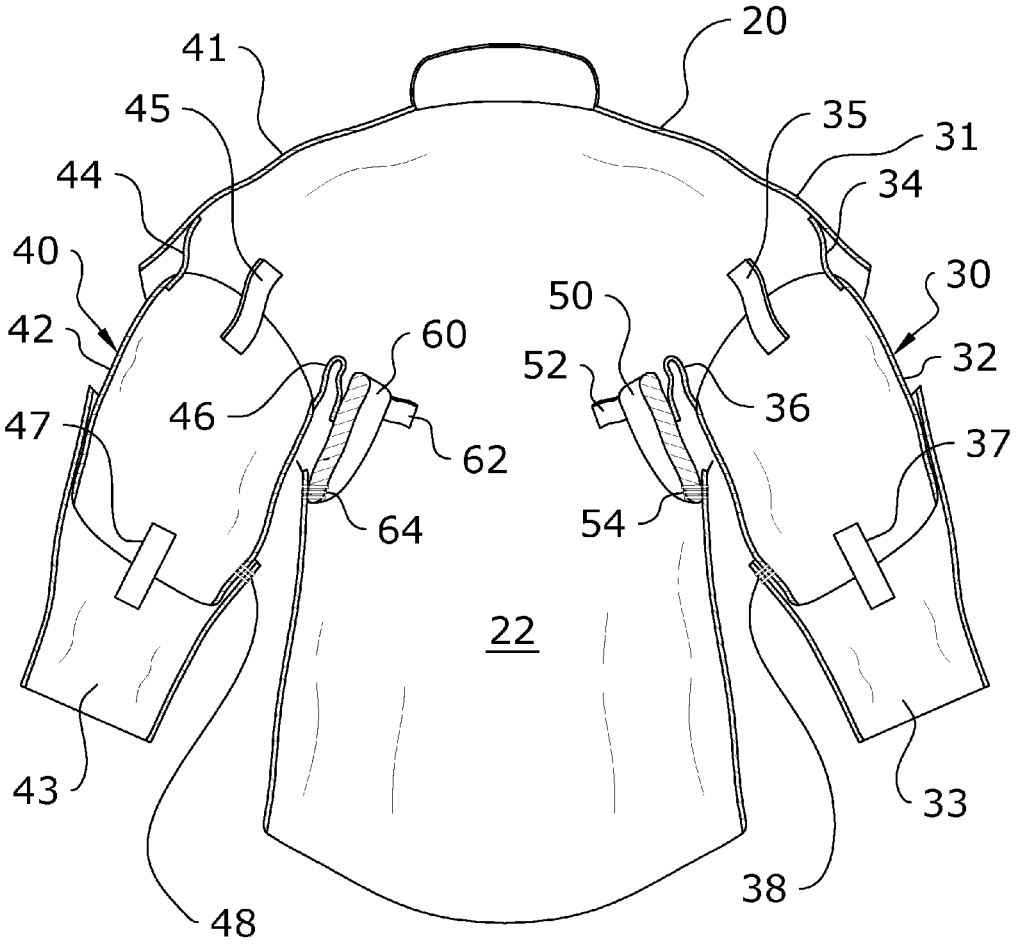
FIG. 4 is a cross sectional view taken along line 4-4 of FIG. 2*a*.
Figure 5:
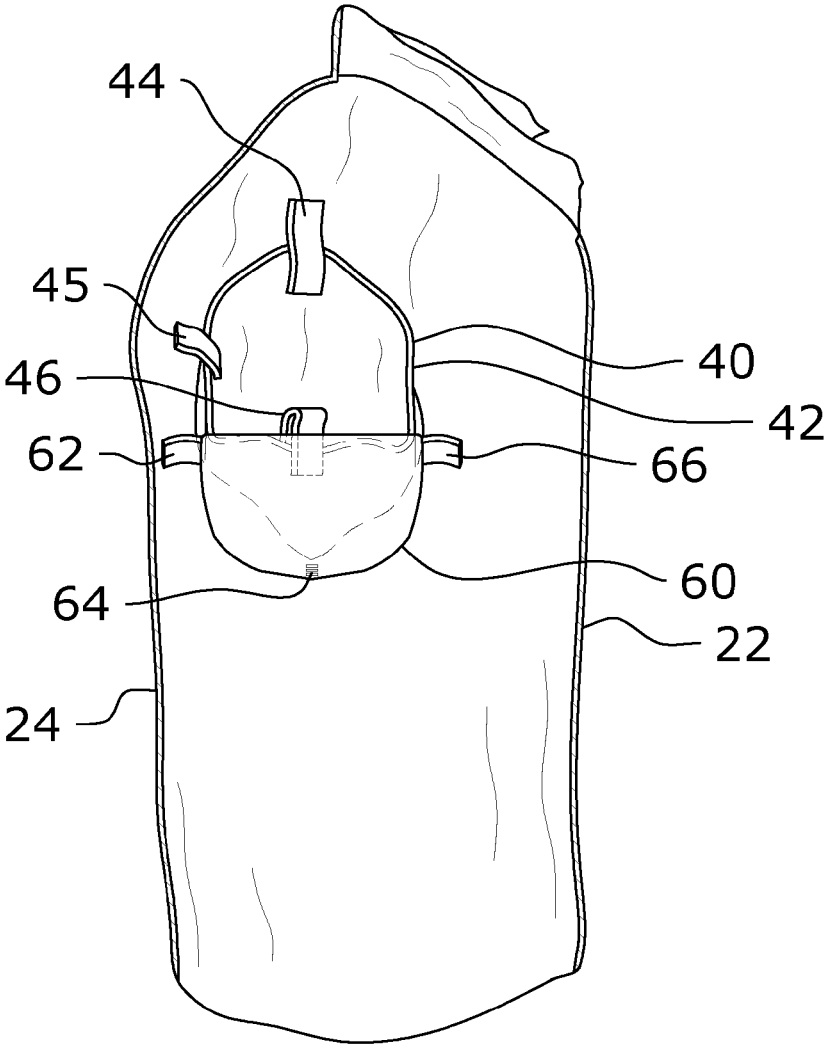
FIG. 5 is a cross sectional view taken along line 5-5 of FIG. 3*c*.

A plurality of straps preferably are connected between the right inner portion 31 and the right middle portion 32 as illustrated in FIGS. 3*b* and 4 of the drawings. The plurality of straps are preferably comprised of elastic straps to allow for increased movement of the right middle portion 32 with respect to the right inner portion 31. The plurality of straps are preferably comprised of a lower right strap 36, an upper right strap 34 and a middle right strap 35 positioned between the upper strap and the lower right strap 36. The lower strap is preferably longer than the middle strap and the upper strap to allow for an increased range of movement when the user raises their right arm.

Figure 6:
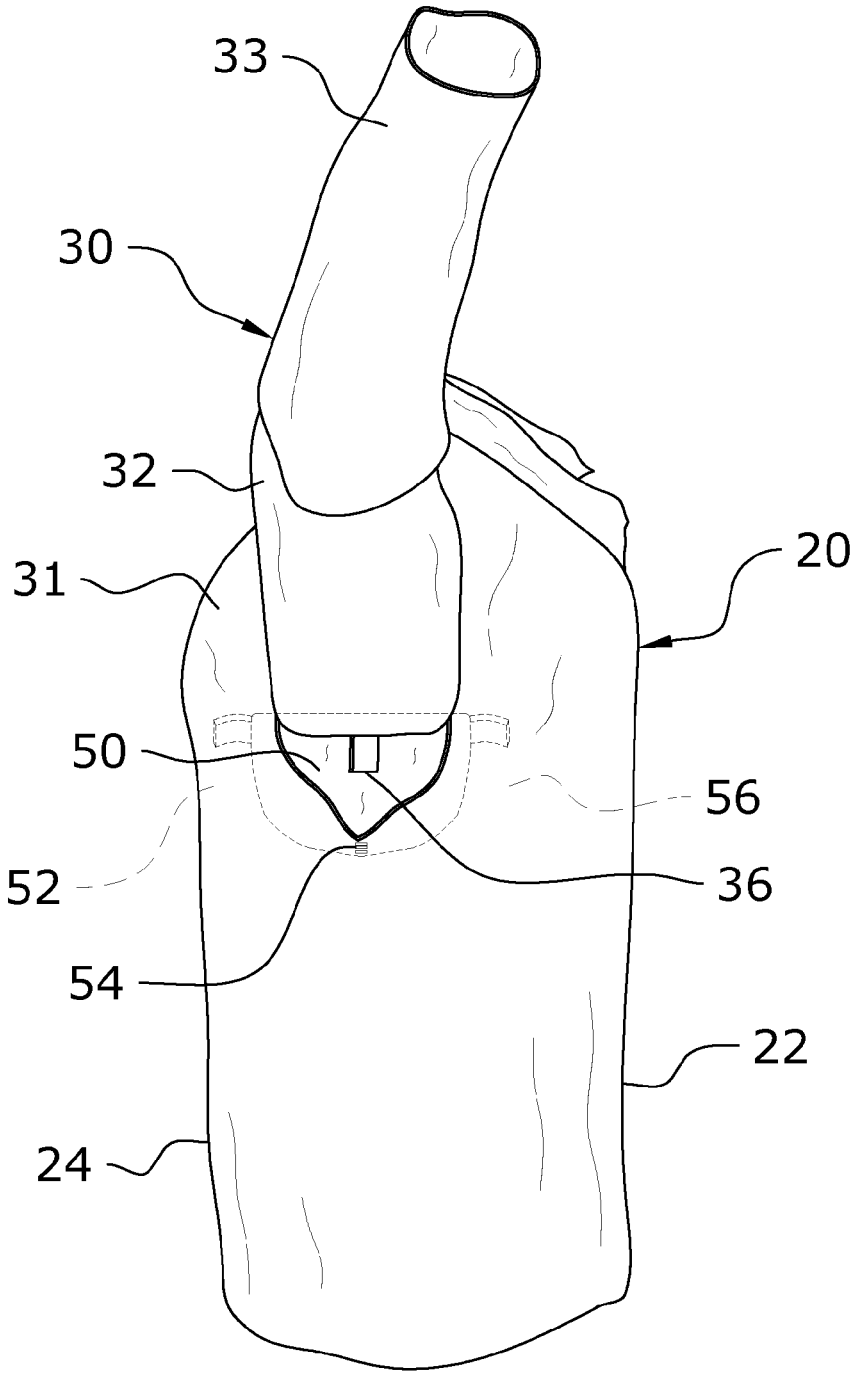
FIG. 6 is a right side view of the coat embodiment with the right sleeve raised illustrating the protection of the right armpit panel of the armpit area.

The lower strap may be attached to the armpit area of the torso portion of the coat 20 or to a right armpit panel 50 that protects the right armpit of the user when they raise their right arm. The right armpit panel 50 is attached on the interior of the torso portion of the coat 20 near the right armpit area and is comprised of a sufficient number of layers of protective material 12 to protect the user. It is preferable that the right armpit panel 50 includes three to fifteen sheets of protective material similar to the front portion of the clothing item 20, 70 to protect the user. The right armpit panel 50 is further shaped and sized sufficiently to completely cover the lower portion of the right distal opening in the right inner portion 31 when the user raises their right arm as best illustrated in FIG. 6 of the drawings. The right armpit panel 50 is movably attached to the interior of the coat 20 in a relatively free moving manner with a first right strap 52 and a second right strap 56 on opposing sides (the straps are preferably elastic straps). The right armpit panel 50 is further directly attached in a relatively non-movable manner with a fastener (e.g. threading, rivets, etc.) to the right armpit area of the clothing at a right attachment location 54 at the lower middle portion of the right armpit panel 50. The lower right strap 36 is preferably attached to the right armpit panel 50 at an upper middle portion to lift the right armpit panel 50 upwardly when the user raises their right arm to assist in covering the right distal opening as illustrated in FIG. 6 of the drawings.

Figure 3C:
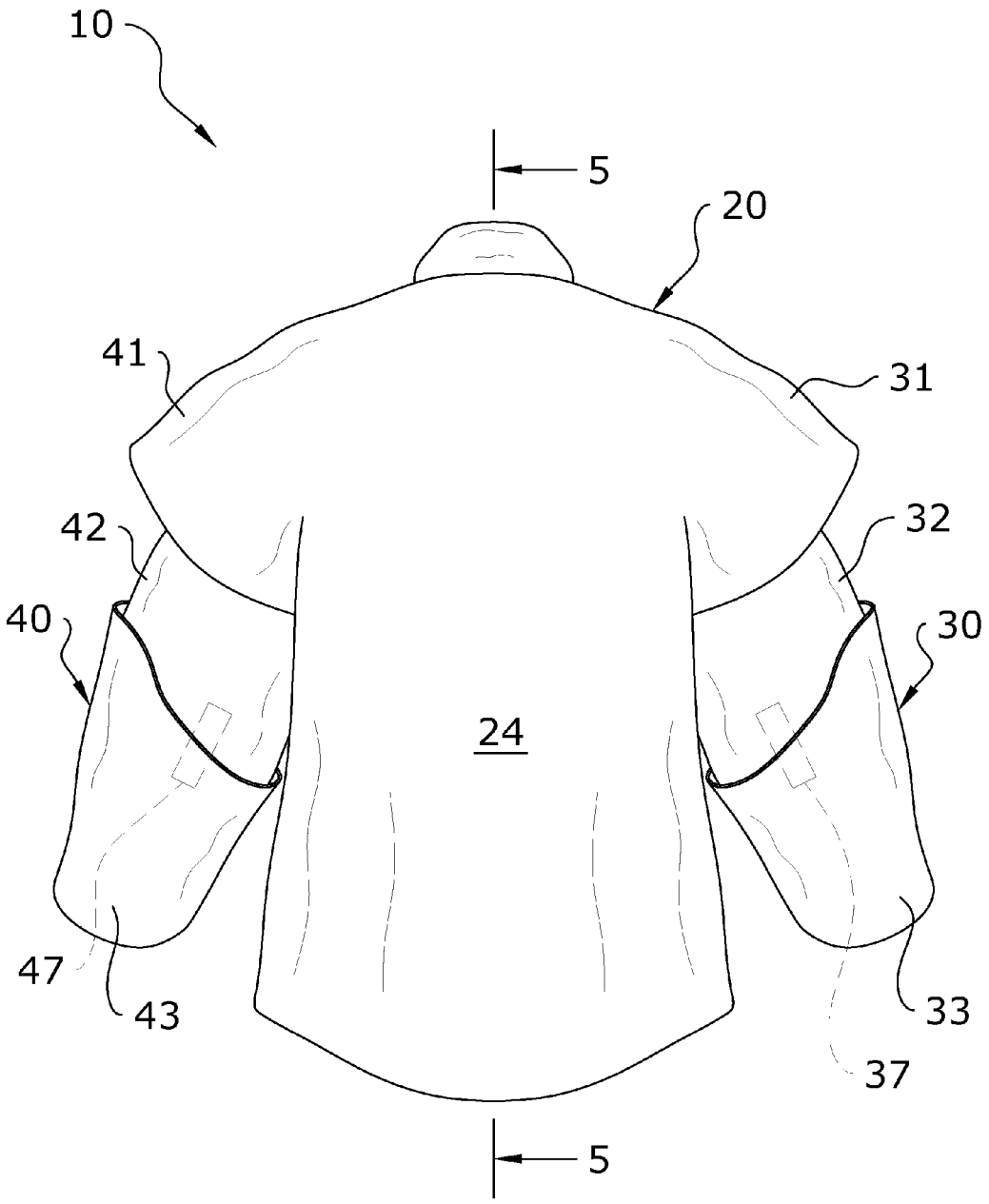
FIG. 3*c* is a rear view of the coat embodiment.

A right outer portion 33 is movably connected to the right middle portion 32 as illustrated in FIGS. 3*a* through 3*c* of the drawings. The right outer portion 33 covers the wrist and forearm portion of the right arm of the user. The right outer portion 33 and the right middle portion 32 are connected approximately near the elbow joint of the user to provide for increased mobility of the right arm such as bending of the elbow. The front portion of the right outer portion 33 is attached to the right middle portion 32 at a right outer attachment location 38 with a fastener such as threading or rivets as illustrated in FIG. 3*a*. The rear portion of the right outer portion 33 is attached to the right middle portion 32 with a right outer strap 37, wherein the right outer strap 37 is preferably an elastic strap to allow for bending of the elbow of the right arm. FIG. 4 illustrates the attachment of the right outer strap 37 to the right sleeve 30. The right outer portion 33 of the right sleeve 30 is preferably larger in diameter on the inner end thereof to surround the distal end of the right middle portion 32 in an overlapping manner as illustrated in FIGS. 3*a*, 3*c* and 4 of the drawings. The right inner portion 31, the right middle portion 32 and the right outer portion 33 are each comprised of tubular structures that are interconnected in a movable manner to form the entire right sleeve 30 having a generally elongated tubular structure that is flexible as illustrated in FIGS. 3*a* through 3*c* of the drawings.

The right sleeve 30 and the left sleeve 40 preferably are comprised of mirrored structures as illustrated in FIGS. 3*a* through 3*b* of the drawings. In particular, the left sleeve 40 includes a left inner joint connected to the torso portion of the coat 20 and a middle joint as illustrated in FIGS. 3*a* through 3*b*. The left sleeve 40 is preferably not directly attached to the torso portion and instead is indirectly attached to the torso portion. The left inner joint is preferably comprised of a plurality of straps attached between the torso portion of the coat 20 and the left sleeve 40. The straps are preferably comprised of elastic straps to allow for increased mobility of the arm of the user during movement of the arm (e.g. raising the arm, moving the arm forward or rearward).

The left sleeve 40 is preferably comprised of a left inner portion 41 that extends outwardly from the upper portion of the torso portion of the coat 20 as illustrated in FIGS. 3*a* through 3*b* of the drawings. The left inner portion 41 is preferably integrally formed with the torso portion but may be attached to the torso portion. The left inner portion 41 extends outwardly from the left side of the torso portion a distance approximately equal to ⅓ of the length of the left sleeve 40 to protect the upper portion of the arm of the user. The left inner portion 41 forms a left distal opening that receives a left middle portion 42 of the left sleeve 40. The left middle portion 42 preferably has an inner end that has a smaller diameter than the left distal opening formed by the left inner portion 41 to movably receive the left middle portion 42 within the left inner portion 41 of the left sleeve 40 thereby allowing relatively free movement of the left middle portion 42 with respect to the left inner portion 41. There is further a sufficient overlapping of the left inner portion 41 over the left middle portion 42 such than the range of movements of the left arm of the user does not expose any portion of the left arm during movement.

A plurality of straps preferably are connected between the left inner portion 41 and the left middle portion 42 as illustrated in FIGS. 3*b* and 4 of the drawings. The plurality of straps are preferably comprised of elastic straps to allow for increased movement of the left middle portion 42 with respect to the left inner portion 41. The plurality of straps are preferably comprised of a lower left strap 46, an upper left strap 44 and a middle left strap 45 positioned between the upper strap and the lower left strap 46. The lower strap is preferably longer than the middle strap and the upper strap to allow for an increased range of movement when the user raises their left arm.

The lower strap may be attached to the armpit area of the torso portion of the coat 20 or to a left armpit panel 60 that protects the left armpit of the user when they raise their left arm. The left armpit panel 60 is attached on the interior of the torso portion of the coat 20 near the left armpit area and is comprised of a sufficient number of layers of protective material 12 to protect the user. It is preferable that the left armpit panel 60 includes three to fifteen sheets of protective material similar to the front portion of the clothing item 20, 70 to protect the user. The left armpit panel 60 is further shaped and sized sufficiently to completely cover the lower portion of the left distal opening in the left inner portion 41 when the user raises their left arm as best illustrated in FIG. 6 of the drawings. The left armpit panel 60 is movably attached to the interior of the coat 20 in a relatively free moving manner with a first left strap 62 and a second left strap 66 on opposing sides (the straps are preferably elastic straps). The left armpit panel 60 is further directly attached in a relatively non-movable manner with a fastener (e.g. threading, rivets, etc.) to the left armpit area of the clothing at a left attachment location 64 at the lower middle portion of the left armpit panel 60. The lower left strap 46 is preferably attached to the left armpit panel 60 at an upper middle portion to lift the left armpit panel 60 upwardly when the user raises their left arm to assist in covering the left distal opening as illustrated in FIG. 6 of the drawings.

A left outer portion 43 is movably connected to the left middle portion 42 as illustrated in FIGS. 3*a* through 3*c* of the drawings. The left outer portion 43 covers the wrist and forearm portion of the left arm of the user. The left outer portion 43 and the left middle portion 42 are connected approximately near the elbow joint of the user to provide for increased mobility of the left arm such as bending of the elbow. The front portion of the left outer portion 43 is attached to the left middle portion 42 at a left outer attachment location 48 with a fastener such as threading or rivets as illustrated in FIG. 3*a*. The rear portion of the left outer portion 43 is attached to the left middle portion 42 with a left outer strap 47, wherein the left outer strap 47 is preferably an elastic strap to allow for bending of the elbow of the left arm. FIG. 4 illustrates the attachment of the left outer strap 47 to the left sleeve 40. The left outer portion 43 of the left sleeve 40 is preferably larger in diameter on the inner end thereof to surround the distal end of the left middle portion 42 in an overlapping manner as illustrated in FIGS. 3*a*, 3*c* and 4 of the drawings. The left inner portion 41, the left middle portion 42 and the left outer portion 43 are each comprised of tubular structures that are interconnected in a movable manner to form the entire left sleeve 40 having a generally elongated tubular structure that is flexible as illustrated in FIGS. 3*a* through 3*c* of the drawings.

E. Clothing Item—Chaps Embodiment

Figure 7A:
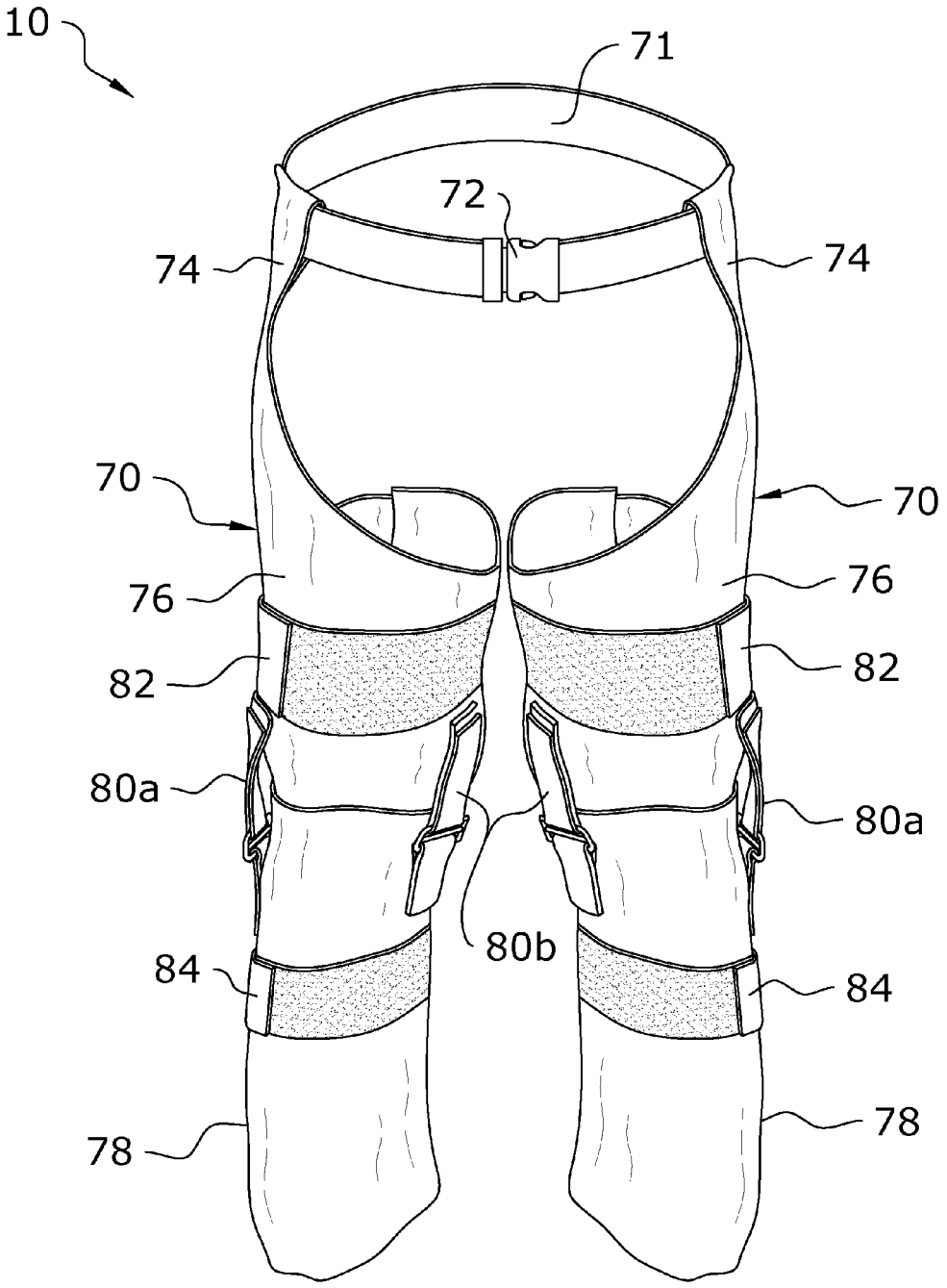
FIG. 7*a* is a front view of the chaps embodiment of the present invention.
Figure 7B:
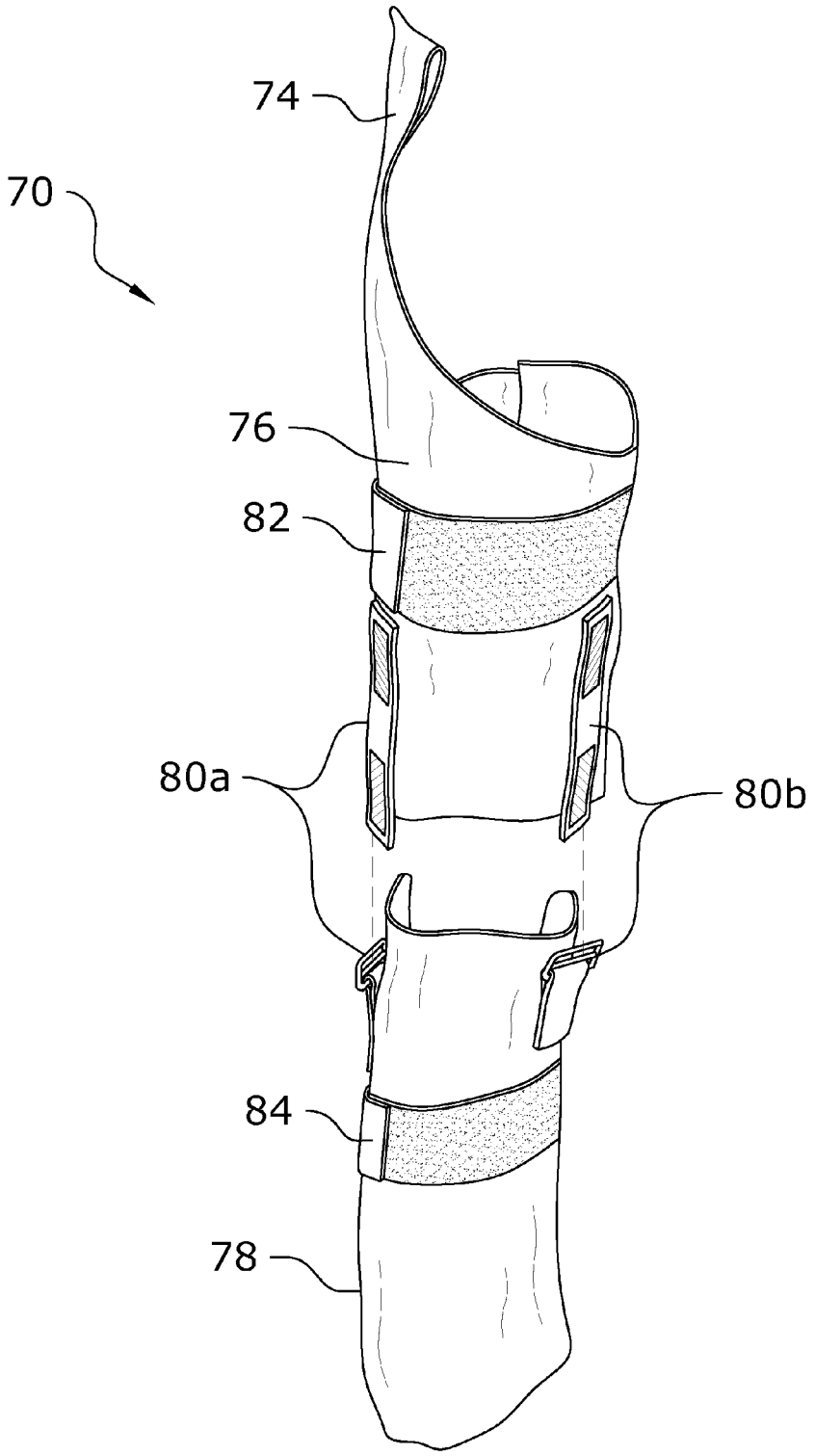
FIG. 7*b* is an exploded front view of a right portion of the chaps embodiment of the present invention.
Figure 7C:
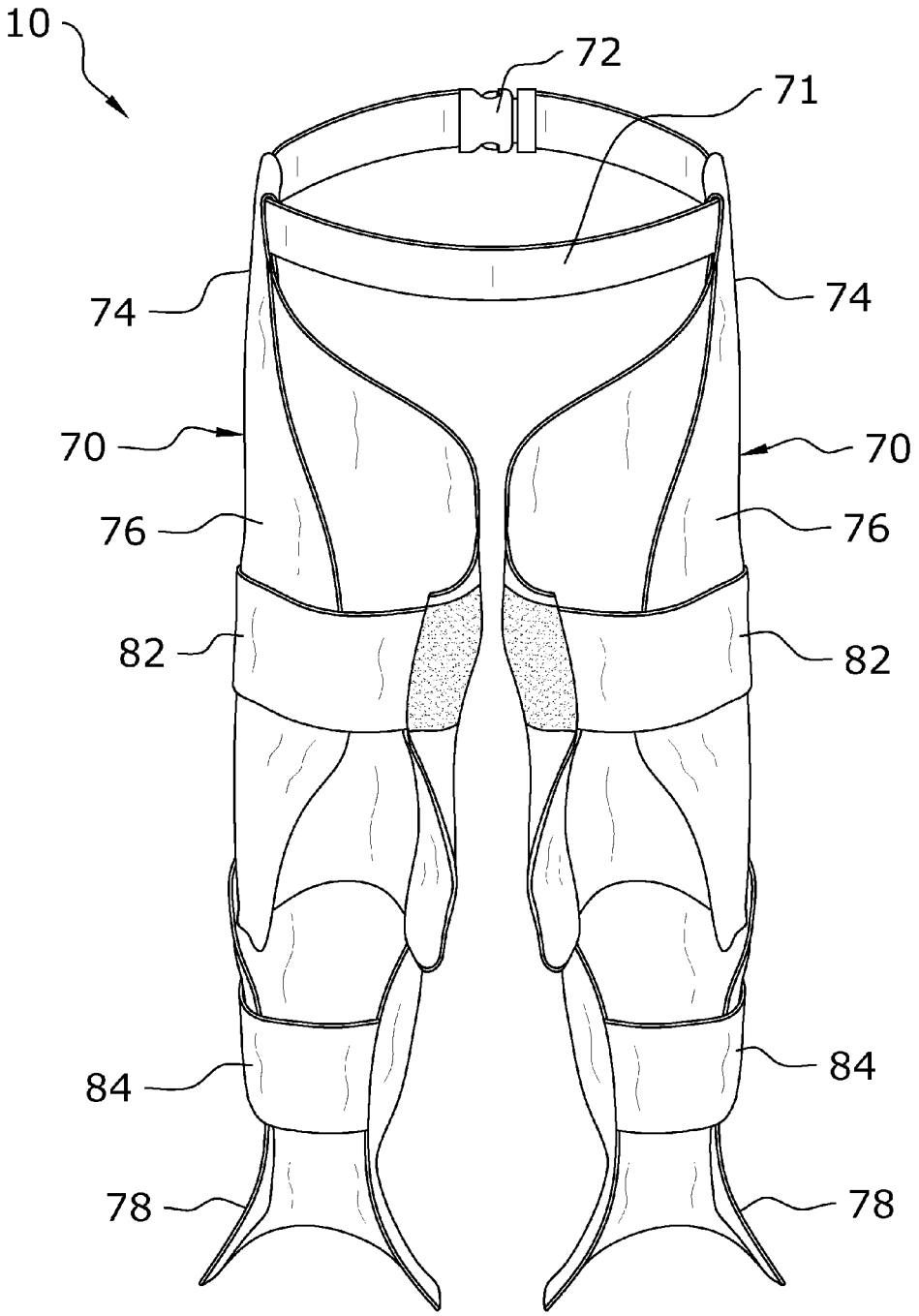
FIG. 7*c* is a rear view of the chaps embodiment.

FIGS. 1*a* through 2*b* and 7*a* through 7*c* illustrate a pair of chaps 70 wherein the front portion of the chaps 70 are comprised of the protective material. FIGS. 7*a* through 7*c* best illustrate the pair of chaps 70. For the purposes of discussion, only the right leg portion of the pair of chaps 70 will be discussed with the left leg portion being a mirror of the right leg portion.

The pair of chaps 70 each include an upper side portion 74 that extends upwardly forming an upper loop at the upper end that receives a belt 71 as illustrated in FIGS. 7*a* through 7*c* of the drawings. The upper side portion 74 extends along the upper side portion 74 of the thigh of the user to protect the user from the side and for securing to the waist of the user with a belt 71 with the lower portion of the coat 20 covering the remaining portion of the legs and thighs. The belt 71 includes a buckle 72 or similar structure to secure the belt 71 around the waist of the user in a secure manner.

An upper chaps portion 76 extends downwardly from the upper side portion 74 and a lower portion is movably attached to the upper chaps portion 76 as further illustrated in FIGS. 7*a* through 7*c* of the drawings. The upper chaps portion 76 is movably connected to the lower chaps portion 78 around the knee joint of the user to provide for increased flexibility of the knee joint of the user. The upper chaps portion 76 is connected to the lower chaps portion 78 with a pair of connecting straps 80*a*, 80*b* that are adjustable in length and may be separated to allow for removal of the lower chaps portion 78 from the upper chaps portion 76 as illustrated in FIG. 7*b* of the drawing. The connecting straps 80*a*, 80*b* preferably use a loop and hook fastener material along with a loop member to movably attached the lower chaps portion 78 to the upper chaps portion 76 in a relatively free moving manner. It is preferable that there is no direct connection of the upper chaps portion 76 and the lower chaps portion 78, but the upper chaps portion 76 and the lower chaps portion 78 may be connected with a conventional fastener (e.g. threading, rivets, buttons). The upper chaps portion 76 and the lower chaps portion 78 may each be comprised of a tubular structure or a U-shaped cross sectional structure having an open rear portion as illustrated in FIG. 7*c* of the drawings. An upper tightening strap 82 is attached to the upper chaps portion 76 to surround and secure the upper chaps portion 76 to the upper portion of the leg of the user. A lower tightening strap 84 is attached to the lower chaps portion 78 to surround and secure the lower chaps portion 78 to the lower portion of the leg of the user. The upper side portion 74 along with the front portion of the upper chaps portion 76 and the lower chaps portion 78 are comprised of between three to fifteen layers of protective material 12 to protect the front of the legs of the user. It is further preferable that the entire upper chaps portion 76 and the lower chaps portion 78 are constructed of three to fifteen layers of protective material 12. The upper end of the lower chaps portion 78 is preferably larger in size than the lower end of the upper chaps portion 76 to overlap the upper chaps portion 76 as illustrated in FIG. 7*a*.

F. Assembly and Usage of One Embodiment of Invention

In one embodiment, the coat 20 and chaps 70 are constructed by sewing a number of layers (sheets) of protective material (the protective material) throughout the inside of the coat 20 and the chaps 70, with a liner of hi-visibility, water resistant nylon fabric on the outside. The coat 20 features hook and loop attachments on the lapel, at the neck, and on the wrists for fast donning and removal, which is necessary and desirable on industrial job sites. The protective level of the products can be customized by adding or removing layers of protective material 12 to any parts of the coat 20. The standard protective level for the front is designed to protect against 40 grain deformable projectiles travelling at 1,000 feet per second or less. The rear of the coat 20 features a much lower protection level, for the possibility of particle ricochets. The chaps 70 may have no rear protection, although protection can be added. ANSI standard reflective striping is added to increase the visibility of the wearer.

The coat 20 is donned as a normal coat 20 would be, then fastened by connecting the hook and loop sections down the front, at the collar, and on the sleeves. The chaps 70 are donned by first connecting the belt 71 around the waist, then using elastic straps with hook and loop to secure the leggings. The coat 20 features a joint system for the arms where the lower extremity is partially detached from the upper arm. There is a small point of attachment in the inside bend of the elbow which is sewn together. The rear of the arm is slanted, extending upward to overlap the unattached points of the lower extremity. This allows the arm to flex at the elbow without encountering resistance, while still covering the entire arm. A small section of woven elastic is attached in the rear of the arm, to help retain and align the two arm sections, retracting the lower arm piece when the wearer's arm is straightened out. The chaps 70 feature a joint system where the lower leg extremity is a completely separate piece from the upper thigh area. The two pieces are connected by straps. The straps loop through rings on the lower leg piece, then attach with hook and loop to the upper leg piece. The straps and attachment point can be adjusted to change the length of the chaps 70 to fit shorter or taller wearers. The chaps 70 are secured around the legs by woven elastic with hook and loop connections. Both the coat 20 and the chaps 70 are designed to be worn for the duration of a job but can be worn for as long as necessary.

The coat 20 and chaps 70 are produced in an alternate Fire Resistant configuration by replacing the hi-visibility nylon liner with a Nomex, treated cotton, or similar fire resistant material liner. The front and rear protection levels can be adjusted. It can be appreciated that raising the protection level in the front and/or back raises the respective weight of the overall product therefore it is important to maximize the protection level against projectiles in the front location where most users experience body piercing objects and lacerations. The coat 20 is may be produced in multiple sizes, from Large to 4XL. The chaps 70 are produced in a one size fits most configuration with custom larger sizes available.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A protective clothing item to prevent bodily injury of a user, comprising:

a clothing item having a front portion and a rear portion, wherein said clothing item is comprised of a coat, wherein said front portion of said clothing item is constructed of a plurality of sheets of protective material layered to form said front portion;

wherein said clothing item includes a torso portion, a right sleeve and a left sleeve, wherein said torso portion is comprised of a front torso portion and a rear torso portion;

wherein said right sleeve includes a right inner joint connected to said torso portion and wherein said left sleeve includes a left inner joint connected to said torso portion;

wherein said left inner joint and said right inner joint are each comprised of a plurality of straps attached between said torso portion and a corresponding sleeve.

2. The protective clothing item of claim 1, wherein said plurality of straps are comprised of elastic straps.

3. The protective clothing item of claim 2, wherein said plurality of straps are comprised of a lower strap, an upper strap and a middle strap positioned between said upper strap and said lower strap.

4. The protective clothing item of claim 3, wherein said lower strap is longer than said middle strap and said upper strap.

5. The protective clothing item of claim 2, wherein said right sleeve and said left sleeve are not directly attached to said torso portion of said clothing item.

6. The protective clothing item of claim 1, including a right armpit panel attached to an interior portion of said clothing item near a right armpit of said coat and a left armpit panel attached to said interior portion of said clothing item near a left armpit of said coat, wherein said right armpit panel and said left armpit panel are each comprised of a plurality of sheets of protective material.

7. The protective clothing item of claim 1, wherein said plurality of sheets of protective material for said front portion of said clothing item are comprised of between three to fifteen sheets of protective material to protect the front body of a user from high velocity particles and lacerating objects.

* * * * *